US007849779B1

(12) United States Patent
Hansen et al.

(10) Patent No.: US 7,849,779 B1
(45) Date of Patent: Dec. 14, 2010

(54) COMPOSITE TREATMENT OF CERAMIC TILE ARMOR

(75) Inventors: James G. R. Hansen, Oak Ridge, TN (US); Barbara J. Frame, Oak Ridge, TN (US)

(73) Assignee: U.T. Battelle, LLC, Oak Ridge, TN (US)

( * ) Notice: Subject to any disclaimer, the term of this patent is extended or adjusted under 35 U.S.C. 154(b) by 692 days.

(21) Appl. No.: 11/338,021

(22) Filed: Jan. 23, 2006

(51) Int. Cl.
*F41H 5/04* (2006.01)
*F41H 1/00* (2006.01)

(52) U.S. Cl. ..... 89/36.02; 89/36.05; 2/2.5

(58) Field of Classification Search ..... 89/36.02, 89/36.05; 2/2.5
See application file for complete search history.

(56) References Cited

U.S. PATENT DOCUMENTS 3,431,818 A * 3/1969 King ..... 89/36.02
3,516,898 A * 6/1970 Cook ..... 428/49
4,732,803 A * 3/1988 Smith, Jr. ..... 428/212
4,944,974 A * 7/1990 Zachariades ..... 428/36.1
5,705,764 A * 1/1998 Schade et al. ..... 89/36.02
5,935,678 A * 8/1999 Park ..... 428/105
6,389,594 B1 * 5/2002 Yavin ..... 2/2.5
6,435,071 B1 * 8/2002 Campbell ..... 89/36.08
6,451,385 B1 9/2002 Hilden et al.
6,500,507 B1 * 12/2002 Fisher ..... 428/36.1
6,601,497 B2 8/2003 Ghiorse et al.
6,642,159 B1 11/2003 Bhatnagar et al.
6,862,970 B2 3/2005 Aghajanian et al.
6,969,553 B1 * 11/2005 Tam et al. ..... 428/364
7,077,048 B1 * 7/2006 Anderson et al. ..... 89/36.02
7,598,185 B2 * 10/2009 Pilpel et al. ..... 442/135
2002/0178900 A1 * 12/2002 Ghiorse et al. ..... 89/36.02
2004/0083880 A1 * 5/2004 Cohen ..... 89/36.02

OTHER PUBLICATIONS

Pro Fiber Zylon, Toyobo Co., Ltd., Techincal Information (revised 2001.9) pp. 1-18.

* cited by examiner

*Primary Examiner*—Stephen M Johnson
(74) *Attorney, Agent, or Firm*—Joseph T. Guy; Nexsen Pruet, LLC

(57) ABSTRACT

An improved ceramic tile armor has a core of boron nitride and a polymer matrix composite (PMC) facing of carbon fibers fused directly to the impact face of the tile. A polyethylene fiber composite backing and spall cover are preferred. The carbon fiber layers are cured directly onto the tile, not adhered using a separate adhesive so that they are integral with the tile, not a separate layer.

14 Claims, 1 Drawing Sheet

COMPOSITE TREATMENT OF CERAMIC TILE ARMOR

STATEMENT REGARDING FEDERALLY FUNDED RESEARCH THE UNITED STATES GOVERNMENT

The United States Government has rights in this invention pursuant to contract number DE-AC05-000R22725 between the United States Department of Energy and U.T. Battelle, LLC.

FIELD OF THE INVENTION

This invention relates to improvements in application of polymer matrix composite materials useful in a ballistic armor.

BACKGROUND OF THE INVENTION

Modern ballistic armor involves a classic balancing of weight versus penetration resistance. Two classes of materials predominate. Metal armor can be fabricated to almost any thickness and alloyed for increased hardness. It is heavy but tends to deform when impacted, allowing it to survive multiple impacts. Ceramic armor is lighter than metal, harder but more fragile. Even when not penetrated it may shatter and be comprised for further use. Personal armor tends toward light ceramics and there is a needed to strengthen the ceramic tiles to withstand multiple impacts.

Multiple layered armor using epoxy adhesives is disclosed in U.S. Pat. No. 5,705,764 to Schade et al. Infiltration of porous ceramics is disclosed in U.S. Pat. No. 6,451,385 to Hilden et al. An armor, including multiple layers of fibers in an elastomeric matrix bonded to a hard metal or ceramic plate, in a perimeter wrapped tile mounted on a backing plate, is disclosed in U.S. Pat. No. 6,601,497 to Ghiorse et al.

BRIEF DESCRIPTION OF THE INVENTION

It is a first objective of this invention to provide a new form of polymer composite matrix facing for a ceramic tile. It is a second object of this invention to provide a different method for preparing a composite tile armor. It is a third object of this invention to provide an armor tile which can withstand multiple impacts without shattering the underlying tile.

These and other objects of the invention can be obtained by providing an oriented fiber composite face to a hardened ceramic tile armor by direct heat and pressure bonding of a non-woven high tensile strength fabric to a ceramic tile.

DETAILED DESCRIPTION OF THE INVENTION

The invention is a composite ceramic-based armor which provides improved resistance to penetration upon initial impact and residual resistance to impact after the initial impact. The composite tile of this invention withstands multiple impacts because the high tensile strength bonded facing strengthens the underlying ceramic tile, moderates shock waves throughout the tile, controls tensile stress changes through the bulk of the ceramic and holds the tile together in the event that the tile is penetrated.

The tile component is selected primarily on the basis of hardness. Non-limiting examples of suitable ceramic materials include aluminum oxide, aluminum nitride, silicon carbide, silicon nitride, boron carbide, titanium diboride and titanium carbide. Mixed ceramics and infused ceramics are encompassed within the scope of the useful ceramics. The salient characteristic is that the ceramic be harder than the incident projectile and have a high compressive strength. The ceramic tile must be able to erode and break up hardened steel penetrators without being destroyed itself.

When the shock wave from the projectile reflects off the back face of a tile it becomes a tensile stress. Excessive tensile stress results in cracks and/or disintegration. Methods to moderate or relieve stress have focused upon laminations of various materials over or around the ceramic tile.

We have discovered that fibers such as glass, aramid, PBO, M5, Rusar and carbon in prepregged form. adhered directly to tile faces provide enhanced impact resistance compared to systems applying adhesives to attach fibers to ceramics. Furthermore, we have discovered that multiple layers of fibers arranged in layers oriented at 90° to each other show superior performance when compared to random orientations (chopped fiber).

Boron carbide ($B_4C$) was selected because of its hardness and availability in armor grade as pressure assisted densification (PAD) material from Cercom Inc., CA, USA. Prepregged carbon fibers, polyacrylonitrilebased (PAN) in oriented tapes were used for laying up the polymer matrix.

The tapes were arranged at 0°/90° in the plane of the tile. The coated tiles were isotactically compressed in a bag which was evacuated and the sealed bag heated to 250° F. for 2-3 hours. Table I shows the construction of the samples.

Figure 1:
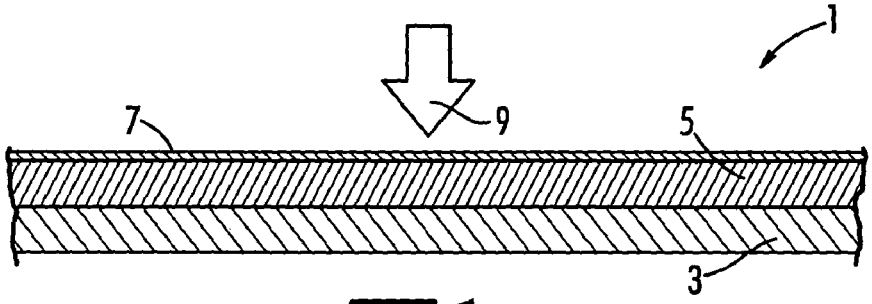
FIG. 1 shows a prior art armor tile without the facing layers of this invention.
Figure 2:
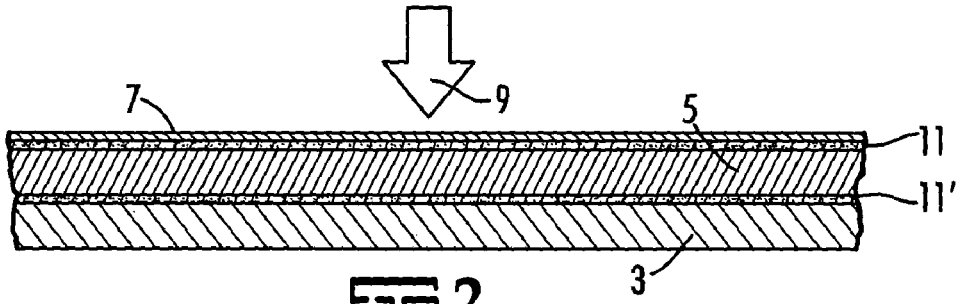
FIG. 2 shows one embodiment of the composite armor tile of this invention.

FIG. 1 shows the prior art tile 1. A backing layer 3 such as Spectra Shield Plus® supports a $B_4C$ tile 5, to the face of which is applied adhesively a spall cover of woven polyethylene fabric. The projectile direction is indicated by arrow 9. FIG. 2 shows the armor of this invention. The adhered carbon fiber composite 11, 11' is adhered to both sides of the $B_4C$ tile.

The ballistic impact testing was conducted versus the armor piercing 7.62 mm AP M61 (NATO .308) round. The powder charge in the cartridge was adjusted to produce varying impact velocities at the target location. The ceramic tile thickness that was selected, 6.2 mm, was chosen to assure that complete penetration of the armor tiles could be achieved within the range of velocities available. The armor targets were mounted on the back surface of a steel plate (relative to the impact direction) using a bolted-on window frame holder that applied a uniform clamping force around the perimeter of the armor tile. The central 76×76 mm (3×3 in.) area of the back face of the armor tile was unsupported during the test. The steel plate with the mounted armor tile was held in a rigid frame at a muzzle-to-target distance of 10 m (30 ft.). A universal receiver on a fixed pedestal was used to fire the rounds at the target. After the bullet was fired, the armor tiles were examined to determine whether the impact resulted in a complete penetration or a partial penetration, in which the armor is partially penetrated, but the projectile is stopped within the armor system. Every effort was made to be consistent in tile preparation, mounting, and testing to assure valid side-by-side comparison of the ballistic impact performance.

Results and Discussion

The results of the ballistic impact tests are summarized in Table II. $V_{50}$ indicates that the tile was penetrated one-half of the time. In all cases where a partial penetration was recorded, the armor tiles having a PMC facing showed improved ballistic impact performance compared to the baseline armor tile without the PMC facing. Although the areal density of the tiles was generally increased by the addition of the PMC facing, this was more than offset by the improvement in penetration resistance. For example, the areal density of sample number 4 with 8 PMC layers was 9% higher than the baseline armor tile, but the apparent ballistic $V_{50}$ was increased by more than 40%.

It has been found that increasing the number of plies in the PMC facing increased the penetration resistance of the armor tile for the range of values tested. Ballistic performance improved monotonically as the number of plies was increased from 0 to 8. It also is apparent that the orientation of the fibers in the PMC plies had an effect on the test results. Fibers arranged at 90° to each other show best results. Differences, if any, in the prepreg resins were not apparent.

TABLE I

Identification and characteristics of fibers used to form the PMC facing layers.

| Sample Number | Fiber | Material | Elastic Modulus | Tensile Strength |
|---|---|---|---|---|
| 2-6 | Toray T700[a] | Carbon | Intermediate | High |
| 7 | Granoc XN-05[b] | Carbon | Low | Low |
| 8 | Toray M46J[a] | Carbon | High | High |
| 9 | Granoc CN-80[b] | Carbon | Ultra-high | Low |
| 10 | Zylon ® (PBO)[c] | Polymer | Intermediate | High |

[a]Toray Carbon Fibers America, Inc.;
[b]Nippon Graphite Fiber Corp.;
[c]Toyobo Company, Ltd.

TABLE II

Armor tile variations and ballistic impact results.

| Sample Number | PMC Fiber | PMC Plies | Fiber Orientation | Areal Density (lb/ft$^2$) | "$V_{50}$"[1] (ft/s) | "V"$_{50}$ Increase (%) | FOM[2] $V_{50}$/Areal Density | FOM Increase (%) |
|---|---|---|---|---|---|---|---|---|
| 1 | No PMC | — | — | 5.26 | 2050 | — | 390 | — |
| 2 | T700 | 2 | 0/90 | 5.20 | >2175 | >6 | >418 | >7.1 |
| 3 | T700 | 4 | 0/90/0/90 | 5.53 | 2550 | 24 | 461 | 18 |
| 4 | T700 | 8 | 0/90/0/90 | 5.73 | >2880 | >40 | >503 | >29 |
| 5 | T700 | 4 | +45/−45/+45/−45 | 5.41 | >2625 | >28 | 485 | >24 |
| 6 | T700 | 4 | 0/−45/+45/90 | 5.44 | no partial | — | — | — |
| 7 | XN-05 | 4 | 0/90/0/90 | 5.35 | 2500 | 22 | 467 | 20 |
| 8 | M46J | 4 | 0/90/0/90 | 5.42 | no partial | — | — | — |
| 9 | CN-80 | 4 | 0/90/0/90 | 5.45 | >2610 | >27 | >479 | >23 |
| 10 | Zylon ® (PBO) | 4 | 0/90/0/90 | 5.43 | >2730 | >33 | >503 | >29 |

[1]For most variations, the number of samples tested was insufficient to determine a true ballistic $V_{50}$ value. $V_{50}$ is the velocity at which 50% of impacts are complete penetrations and 50% are partial penetrations.
[2]The Figure of Merit (FOM) is defined as the $V_{50}$ velocity with units of ft/s divided by the areal density with units of lb/ft$^2$ The reason for the improvement in ballistic impact performance when the PMC facing layers were present is not yet fully understood, while not being bound by any theory. It may be speculated that the composite layers act to delay the onset of fracture and fragmentation of the ceramic material. The composite layers may provide a lateral constraint on the ceramic tile, which could slow the spread of cracks and the separation of tile fragments. Based on the observed effect of the fiber orientation, it is also possible that the PMC layers may provide a form of acoustical damping that affects the propagation of stress waves in the ceramic tile resulting in delayed fracture.

It is not known whether similar effects would be observed with $B_4C$ from other suppliers or with alternative ceramic armor materials such as $Al_2O_3$, SiC, and $Si_3N_4$.

The invention has been described on the basis of representative examples which are in no way limitative of the invention. Modifications apparent to a person with skill in the art are included within the scope of the invention.

INDUSTRIAL UTILITY

Armored tiles, according to this invention have utility in any occupation in which a person might be subject to being shot, such as in law enforcement and transportation of money and precious gems. Scatter shields for protection against mechanical equipment failure are also envisioned for the invention.

We claim:

1. An improved polymer matrix composite reinforced ballistic armor tile comprising:

a) a ceramic tile;

b) a backing, and;

c) a polymer matrix composite facing adhered directly to at least one face of said tile under conditions of sealed compression and heat wherein said composite comprises at least two fiber comprising layers wherein fibers in a first layer of said two layers are oriented at 90° relative to second fibers in a second layer of said two layers wherein said polymer matrix composite reinforced ballistic armor tile has a FOM of over 418 lb/ft$^2$.

2. An improved polymer matrix ballistic armor tile according to claim 1 wherein said tile is a ceramic tile selected from the group consisting of aluminum oxide, silicon carbide, silicon nitride, boron carbide, titanium diboride and titanium carbide.

3. An improved polymer matrix composite reinforced ballistic armor tile according to claim 2 wherein said ceramic tile is boron carbide.

4. An improved polymer matrix composite reinforced ballistic armor tile according to claim 1 wherein said backing is a metal plate.

5. An improved polymer matrix composite reinforced ballistic armor tile according to claim 1 wherein said polymer composite facing is a polymer reinforced with fibers from the group consisting of glass, aramid, poly-p-phenylenebenzobisoxazole, poly{diimidazo pyridinylene(dihydroxy)phenylene}, p-phenylene terephtalamide and carbon.

6. An improved polymer matrix composite reinforced ballistic armor tile according to claim 5 wherein said fiber is carbon fiber.

7. An improved polymer matrix composite reinforced ballistic armor tile according to claim 6 wherein said carbon fiber is a polyacrylonitrile based fiber.

8. An improved polymer matrix composite reinforced ballistic armor tile according to claim 1 further incorporating a spall cover.

9. An improved polymer matrix composite reinforced ballistic armor tile according of claim 8 wherein said spall cover is polyethylene fiber composite.

10. An improved polymer matrix composite reinforced ballistic armor tile according to claim 1 wherein said polymer matrix is cured as a coating on one face of said tile.

11. An improved polymer matrix composite reinforced ballistic armor tile according to claim 1 wherein said polymer matrix is adhered to an opposite face from a first face of said at least one face of said tile.

12. An improved polymer matrix composite reinforced ballistic armor tile comprising:

a) a ceramic tile;

b) a backing, and;

c) a polymer matrix composite facing adhered directly to said ceramic tile by pressure and heat comprising at least two fiber comprising layers wherein fibers in a first layer of said two layers are oriented at 90° relative to second fibers in a second layer of said two layers; wherein said polymer matrix composite reinforced ballistic armor tile has a FOM of over 418 $lb/ft^2$.

13. The improved polymer matrix composite reinforced ballistic armor tile of claim 12 with a FOM of over 479 $lb/ft^2$.

14. The improved polymer matrix composite reinforced ballistic armor tile of claim 13 with a FOM of over 503 $lb/ft^2$.

* * * * *